US011203800B2

(12) United States Patent
Kang

(10) Patent No.: US 11,203,800 B2
(45) Date of Patent: Dec. 21, 2021

(54) ALUMINUM ALLOY FOR PISTON AND PISTON FOR ENGINE OF VEHICLE

(71) Applicants: HYUNDAI MOTOR COMPANY, Seoul (KR); Kia Motors Corporation, Seoul (KR)

(72) Inventor: Hee-Sam Kang, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 97 days.

(21) Appl. No.: 16/685,072

(22) Filed: Nov. 15, 2019

(65) Prior Publication Data

US 2020/0181740 A1 Jun. 11, 2020

(30) Foreign Application Priority Data

Dec. 10, 2018 (KR) ..... 10-2018-0158371

(51) Int. Cl.
*C22C 21/00* (2006.01)
*C22C 21/06* (2006.01)
*F02F 3/00* (2006.01)

(52) U.S. Cl.
CPC ..... *C22C 21/06* (2013.01); *F02F 3/0084* (2013.01); *F02F 2003/0007* (2013.01)

(58) Field of Classification Search
CPC . F05C 2201/021; F05C 2201/028; F02F 3/00; C22C 1/0416; B22D 11/003
USPC ..... 420/532
See application file for complete search history.

(56) References Cited

U.S. PATENT DOCUMENTS

| | | | | |
|---|---|---|---|---|
| 5,135,713 | A * | 8/1992 | Rioja | C22C 21/00 148/417 |
| 5,169,462 | A * | 12/1992 | Morley | C22C 21/02 148/437 |
| 7,682,469 | B2 | 3/2010 | Ikuno et al. | |
| 9,896,747 | B2 | 2/2018 | Kang | |
| 2007/0234994 | A1* | 10/2007 | Wang | F02F 3/10 123/193.1 |
| 2008/0134879 | A1* | 6/2008 | Hofbauer | F02F 3/22 92/186 |
| 2012/0207640 | A1* | 8/2012 | Harrigan, Jr. | C22C 32/00 419/13 |
| 2018/0126452 | A1* | 5/2018 | Gao | B22D 15/005 |

FOREIGN PATENT DOCUMENTS

| | | | |
|---|---|---|---|
| JP | 2753880 | B2 | 5/1998 |
| JP | 3194531 | B2 | 7/2001 |
| JP | 2003-096531 | A | 4/2003 |
| JP | 2014-109045 | A | 6/2014 |
| JP | 5642518 | B2 | 12/2014 |
| KR | 10-1565025 | B1 | 11/2015 |

* cited by examiner

*Primary Examiner* — Long T Tran
*Assistant Examiner* — James J Kim
(74) *Attorney, Agent, or Firm* — McDonnell Boehnen Hulbert & Berghoff LLP

(57) ABSTRACT

An aluminum alloy for a piston may include aluminum (Al) as a base, magnesium (Mg) and zinc (Zn); and wherein the magnesium content is 10-20 wt % with reference to the total weight. In the aluminum alloy, the zinc content is 2.0-6.4 wt % with reference to the total weight. The aluminum alloy further includes copper (Cu) of 1.5-3.5 wt % with reference to the total weight. In the aluminum alloy, T-AlCuMgZn phase is generated.

4 Claims, 1 Drawing Sheet

ALUMINUM ALLOY FOR PISTON AND PISTON FOR ENGINE OF VEHICLE

CROSS-REFERENCE(S) TO RELATED APPLICATIONS

This application claims priority to Korean Patent Application No. 10-2018-0158371, filed on Dec. 10, 2018, which is incorporated herein by reference in its entirety.

BACKGROUND OF THE DISCLOSURE

Field of the Disclosure

The present disclosure relates to aluminum alloy, and more particularly, aluminum alloy for manufacturing a piston for a vehicle engine.

Description of the Related Art

A piston performs linear reciprocal motion in a cylinder block and the piston is a component of an engine moving system which generates rotational force by transmitting the kinetic energy received from the gas of high temperature and pressure in the explosion stroke to the crankshaft through a connecting rod. In addition, the piston is almost the only aluminum part among of the engine moving system that is driven under severe operating conditions of high temperature and high pressure.

Korean Registration Patent Publication No. 10-1565025, Japanese Registration Patent Publication No. 5642518, and Japanese Registration Patent Publication No. 3194531 disclose related technology.

The foregoing is intended merely to aid in the understanding of the background of the present disclosure, and is not intended to mean that the present disclosure falls within the purview of the related art that is already known to those skilled in the art.

SUMMARY OF THE DISCLOSURE

The present disclosure provides an aluminum alloy for a piston and a piston for a vehicle engine that is low in density, low in cost, and can satisfy both light weight and heat resistance.

Aluminum alloy for a piston according to one aspect of the present disclosure may include aluminum (Al) as a base, magnesium (Mg) and zinc (Zn); and wherein the magnesium content is 10-20 wt % based on the total weight.

In addition, the zinc content may be 2.0-6.4 wt % with reference to the total weight.

Additionally, copper (Cu) of 1.5-3.5 wt % with reference to the total weight may be further included.

Further, T-AlCuMgZn strengthening phase may be generated.

Aluminum alloy for a piston according another aspect of the present disclosure may include aluminum (Al) as a base, magnesium (Mg) and zinc (Zn); and wherein the zinc content is 2.0-6.4 wt % with reference to the total weight.

Additionally, copper (Cu) of 1.5-3.5 wt % with reference to the total weight may be further included.

Further, T-AlCuMgZn strengthening phase may be generated.

Next, a piston for a vehicle engine according to one aspect of the present disclosure may include aluminum (Al) as a base, magnesium (Mg) and zinc (Zn); and being manufactured by aluminum alloy in which the magnesium content is 10-20 wt % with reference to the total weight.

Further, the zinc content of the aluminum alloy may be 2.0-6.4 wt % with reference to the total weight.

In addition, the aluminum alloy may further include copper (Cu) of 1.5-3.5 wt % with reference to the total weight.

T-AlCuMgZn strengthening phase may be generated in the aluminum alloy.

The aluminum alloy for a piston of the present disclosure makes it possible to reduce the cost and weight of the piston because the content of Cu and Ni is not contained or smaller than that of the aluminum alloy typically used for a piston.

In addition, by forming the T-AlCuMgZn phase by Mg and Zn contents which are different from the typical ones, it is possible to further improve the heat resistance and durability.

Additionally, the anodizing characteristic is excellent and the permanent deformation amount is reduced, so that the dimensional stability can be further improved at high temperature.

BRIEF DESCRIPTION OF THE DRAWINGS

The above and other aspects, features and advantages of the present disclosure will be more clearly understood from the following detailed description taken in conjunction with the accompanying drawings, in which:

FIG. 2A is the anodizing characteristic by the aluminum alloy of the present disclosure and FIG. 2B is the anodizing characteristic based on a typical aluminum alloy.

DESCRIPTION OF EMBODIMENTS

Figure 1:
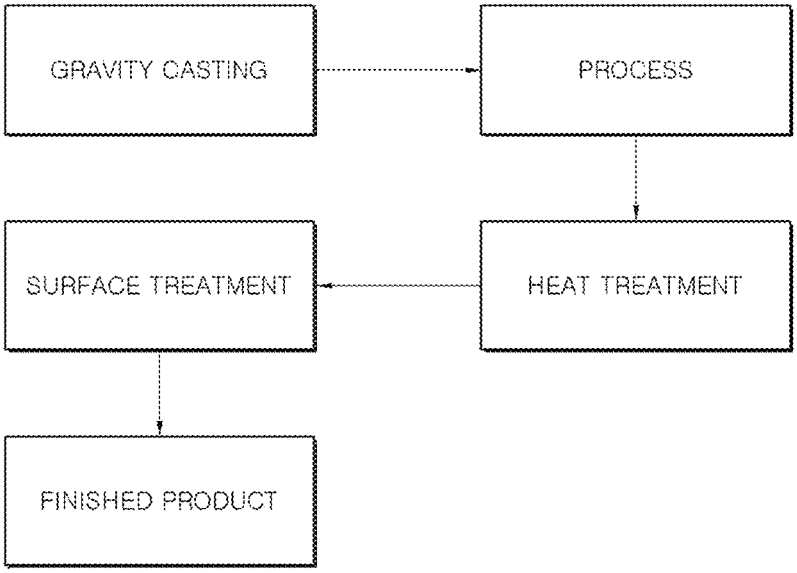
FIG. 1 shows the manufacturing process of a piston by the aluminum alloy of the present disclosure.

In order to fully understand the present disclosure, the benefits achieved by the performance of the present disclosure and the features and advantages achieved by embodiments of the present disclosure, it should refer to the accompanying drawings that illustrate embodiments of the present disclosure and the description in the accompanying drawings.

In describing embodiments of the present disclosure, known techniques or repetitive description that would unnecessarily obscure the point of the present disclosure would be summarized or omitted.

A piston may be manufactured mostly through gravity casting technique by applying a special aluminum alloy with the enhanced heat resistance, and the hot-forging is applied to the piston when additional light weight or durability improvement is required.

The piston may be made of aluminum alloy for the piston. Si and Ni may be added to the alloy in excess to improve heat resistance and in general, Al-12Si-3Cu-2Ni alloy or Al-12Si-4Cu-3Ni alloy is mainly used.

The piston requires excellent durability to heat resistance for performing linear reciprocal motion at high speed, and also requires light weight for enhancement of fuel efficiency.

However, as mentioned above, the aluminum alloy for the piston is high in content of Si and Ni and high in density compared to the aluminum alloy for general casting, and the price is high. Therefore, when pursuing durability, cost and weight may be increased. On the other hand, when pursuing light weight, it may be needed to compromise durability.

Pistons among the components of an engine moving system is manufactured with aluminum alloys and the present disclosure provides an aluminum alloy for manufacturing pistons. While a typical aluminum alloy have been difficult to satisfy both light weight and heat resistance, an aluminum alloy according to the present disclosure makes it possible to reduce weight and cost, and yet, and offers excellent durability and heat resistance compared to the typical aluminum alloy.

In embodiments, in the aluminum alloy for the piston of the present disclosure, Al is used as a base material and Cu, Mg and Zn are mixed.

In one embodiment, Si and Ni are not contained. The composition of the aluminum alloy of the present disclosure and the composition of an aluminum alloy with Si and Ni (which is referred to as "typical aluminum alloy" in the present disclosure) are shown in Table 1.

TABLE 1

| | composition range (wt %) | | | | |
|---|---|---|---|---|---|
| composition | Mg | Zn | Cu | Si | Ni |
| Aluminum alloy of the present disclosure | 10-20 | 2.0-6.4 | 1.5-3.5 | — | — |
| Typical aluminum alloy | 0.3 or less | 0.5 or less | 3.0-4.0 | 11-13 | 2.0-3.0 |

As shown in Table 1, in one embodiment, in the aluminum alloy for the piston of the present disclosure, Al is used as a base material, Cu 1.5-3.5 wt %, Mg 10-20 wt %, Zn 2.0-6.4 wt % are added and Si and Ni are not added.

Mg combines with aluminum and other elements to form T-AlCuMgZn phase as the main heat-resistant strengthening phase.

If Mg is added too little, the strengthening phase or reinforcing phase is not sufficiently generated so that heat resistance required for the piston cannot be secured. When Mg is added too much, the amount of T-AlCuMgZn phase is not increased to be coarsened so that brittleness occurs. In embodiments, Mg in an amount of 10-20 wt % is added.

In addition, Zn is a key element for forming a T-AlCuMgZn phase. When Zn is added too little, no T-AlCuMgZn phase is formed and an Al—Mg-based intermetallic compound is formed so that heat resistance is reduced. When Zn is added too much, the amount of T-AlCuMgZn phase is not increased to be coarsened so that brittleness occurs. In embodiments, Zn in an amount of 2.0-6.4 wt % is added.

Additionally, Cu contributes to form a T-AlCuMgZn phase with the highest strengthening characteristic by bonding with an Al—Mg—Zn based intermetallic compound and enhances the strength.

Therefore, in embodiments, Cu is added by at least 1.5 wt % to form the desired strengthening phase and obtain a high strength characteristic. On the other hand, when Cu is added too much, there is no additional strengthening effect, and shrinkage defects are increased during casting so that quality is deteriorated.

The piston of the present disclosure is made with the aluminum alloy having the above composition and may be manufactured by using gravity casting technique as shown in FIG. 1. In embodiments, hot forging may be further performed to make the piston.

As an example of the gravity casting, the temperature of the molten metal is set to at least 680° C. to ensure fluidity and to a maximum of 750° C. to avoid oxidation and gas pocket of the melt.

In addition, material produced by the gravity casting is subjected to the roughing and finishing process to become a finished piston product, and T5 heat treatment is performed to ensure dimensional stability.

In embodiments, the temperature is kept at a minimum of 200° C. or more in order to eliminate the instability. In one embodiment, the temperature is limited to a maximum of 250° C. in order to prevent or avoid degradation of physical properties due to deterioration.

Heat treatment time may vary depending on the size of the product, preferably 2-6 hours range.

Finally, printing for lubrication may be applied to the skirt area, and anodizing surface treatment for wear resistance may be applied to the top ring groove.

Table 2 and Table 3 summarize and test results of aluminum alloys, depending on the amount of Mg and Zn.

TABLE 2

| Aluminum | composition range (wt %) | | | T-AlCuMgZn phase fraction | 350° C. high temperature tensile strength |
|---|---|---|---|---|---|
| alloys | Mg | Zn | Cu | (%) | (MPa) |
| 1 | 9 | 4.3 | 2 | 0 | 20 |
| 2 | 9.5 | 4.3 | 2 | 0 | 21 |
| 3 | 10 | 4.3 | 2 | 1.5 | 44 |
| 4 | 11 | 4.3 | 2 | 2 | 47 |
| 5 | 12 | 4.3 | 2 | 2.7 | 50 |
| 6 | 13 | 4.3 | 2 | 3.7 | 53 |
| 7 | 14 | 4.3 | 2 | 4.9 | 57 |
| 8 | 15 | 4.3 | 2 | 6.4 | 62 |
| 9 | 16 | 4.3 | 2 | 8.2 | 68 |
| 10 | 17 | 4.3 | 2 | 10.0 | 76 |
| 11 | 18 | 4.3 | 2 | 11.5 | 82 |
| 12 | 19 | 4.3 | 2 | 12.7 | 87 |
| 13 | 19.5 | 4.3 | 2 | 13.5 | 91 |
| 14 | 20 | 4.3 | 2 | 14.0 | 93 |
| 15 | 20.5 | 4.3 | 2 | 14.0 | 91 |
| 16 | 21 | 4.3 | 2 | 14.0 | 88 |

Table 2 shows the results of confirming the strengthening phase fraction and high temperature tensile strength by varying Mg content in Al-xMg-4.3Zn-2Cu based alloy to confirm the influence of Mg content.

When 9 wt % and 9.5 wt % of Mg are added in an amount of less than 10 wt %, it is able to confirm that the strengthening phase is not generated, and it can be seen that there is no improvement effect of high temperature strength because the strengthening or reinforcing phase is not generated.

On the other hand, it can be seen that the strengthening phase is formed and the high temperature strength is improved from the addition of 10 wt % or more, and the strengthening phase fraction and tensile strength are improved as the amount of Mg increases.

Instead, it can be seen that when added in an amount of 20.5 wt % and 21 wt % by exceeding 20 wt %, there is no further increase of the strengthening phase fraction, but rather, the properties are degraded by the coarsening of the strengthening phase.

TABLE 3

| Aluminum alloys | Composition range (wt %) Mg | Zn | Cu | T-AlCuMgZn phase fraction (%) | 350° C. high temperature tensile strength (MPa) |
|---|---|---|---|---|---|
| 1 | 15 | 1.2 | 2 | 0 | 15 |
| 2 | 15 | 1.6 | 2 | 0 | 17 |
| 3 | 15 | 2.0 | 2 | 2.7 | 50 |
| 4 | 15 | 2.4 | 2 | 3.4 | 52 |
| 5 | 15 | 2.8 | 2 | 4.3 | 55 |
| 6 | 15 | 3.2 | 2 | 5.1 | 57 |
| 7 | 15 | 3.6 | 2 | 6.1 | 60 |
| 8 | 15 | 4.0 | 2 | 7.2 | 64 |
| 9 | 15 | 4.4 | 2 | 8.3 | 69 |
| 10 | 15 | 4.8 | 2 | 9.4 | 74 |
| 11 | 15 | 5.2 | 2 | 10.2 | 77 |
| 12 | 15 | 5.6 | 2 | 10.8 | 79 |
| 13 | 15 | 6.0 | 2 | 11.2 | 81 |
| 14 | 15 | 6.4 | 2 | 11.4 | 82 |
| 15 | 15 | 6.8 | 2 | 11.4 | 80 |
| 16 | 15 | 7.2 | 2 | 11.4 | 79 |

Table 3 shows the results of confirming the strengthening phase fraction and high temperature tensile strength by varying Zn content in Al-15Mg-xZn-2Cu based alloy to confirm the influence of Zn content.

When 1.2 wt % and 1.6 wt % of Zn are added in an amount of less than 2 wt %, it is able to confirm that the strengthening phase or reinforcing phase is not generated, and it can be seen that there is no improvement effect of high temperature strength because the strengthening phase is not generated.

On the other hand, it can be seen that the strengthening phase is formed and the high temperature strength is improved from the addition of 2 wt % or more, and the strengthening phase fraction and tensile strength are improved as the addition amount increases.

Instead, it can be seen that when added in an amount of 6.8 wt % and 7.2 wt % by exceeding 6.4 wt %, there is no further increase of the strengthening phase fraction, but rather, the properties are degraded by the coarsening of the strengthening phase.

As described above, the aluminum alloy of the present disclosure does not add Si, Ni so that 5 to 10% density reduction effect and light weight can be made and the high temperature fatigue characteristic can be also improved by about 50%.

As a result, the economic effect of cost reduction is demonstrated.

The results of this property experiment are summarized in Table 4, and experiment results in Table 4 are from by Al-13Mg-4.3Zn-2Cu among embodiments of the present disclosure.

TABLE 4

| | density(g/cm$^3$) | room temperature strength (MPa) | High temperature strength (MPa, 350° C. reference) |
|---|---|---|---|
| Aluminum alloy of the present disclosure | 2.5-2.6 | 230 | 75 |
| Typical aluminum alloy | 2.78 | 200 | 50 |

It was also found that the permanent deformation of the piston exterior diameter is measured according to the composition of the aluminum alloy of the present disclosure, so that the high temperature dimensional stability is improved by about 50% as shown in Table 5.

TABLE 5

| | Deformation amount (μm) Aluminum alloy of the present disclosure | typical aluminum alloy |
|---|---|---|
| average | 10.4 | 19.8 |
| maximum | 12 | 21 |
| minimum | 9 | 19 |

In addition, it was confirmed that the characteristic by the anodizing surface treatment was also improved.

Figure 2A:
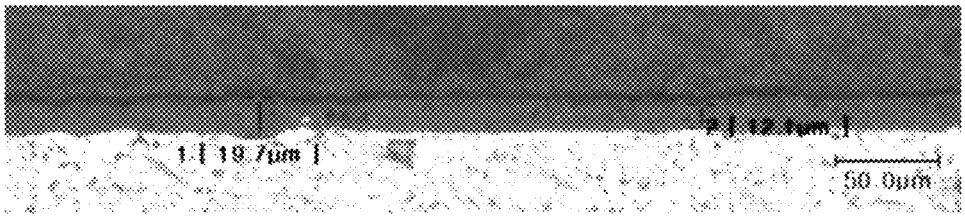
FIGS. 2A and 2B show the comparison of the anodizing characteristic.
Figure 2B:
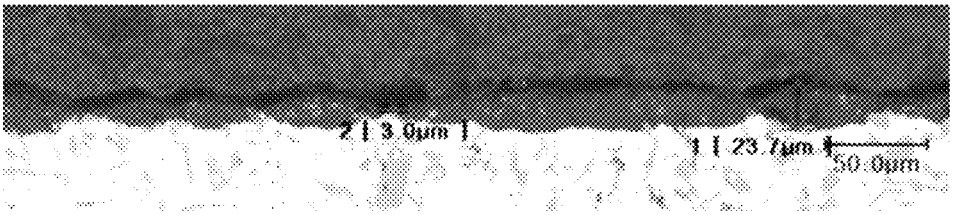

FIG. 2A is the surface of the aluminum alloy of the present disclosure and FIG. 2B is the surface of the typical aluminum alloy.

It was confirmed that uniformity of the thickness was improved, and the illuminance was improved. Aluminum alloy of the present disclosure shows the average Ra 0.815 (Rz 5.701) and the typical aluminum alloy shows the average Ra 2.047 (Rz 10.625).

Although the present disclosure has been described with reference to the drawings, it is to be understood that the present disclosure is not limited to the disclosed embodiments, and it will be apparent to those skilled in the art that various changes and modifications may be made without departing from the spirit and scope of the present disclosure. Accordingly, such modifications or variations should fall within the scope of the claims of the present disclosure, and the scope of the present disclosure should be construed on the basis of the appended claims.

What is claimed is:

1. An aluminum alloy for a piston, comprising:

aluminum (Al) as a base, magnesium (Mg) and zinc (Zn);

wherein the magnesium content is 10-20 wt % with reference to the total weight;

wherein the zinc content is 2.0-6.4 wt % with reference to the total weight; and wherein T-AlCuMgZn phase is generated.

2. The aluminum alloy for the piston of claim 1, further comprising copper (Cu) of 1.5-3.5 wt % with reference to the total weight.

3. A piston for a vehicle engine, comprising:

an aluminum alloy comprising aluminum (Al) as a base, magnesium (Mg) and zinc (Zn), wherein the magnesium is 10-20 wt % with reference to the total weight;

wherein the zinc content is 2.0-604 wt % with reference to the total weight; and wherein T-AlCuMgZn phase is generated.

4. The piston for the vehicle engine of claim 3, wherein the aluminum alloy further comprises copper (Cu) of 1.5-3.5 wt % with reference to the total weight.

* * * * *